United States Patent [19]

Kenyon et al.

[11] 3,976,349

[45] Aug. 24, 1976

[54] ELECTRICAL SOCKET

[75] Inventors: Lewis W. Kenyon, Flat Rock; James L. Grindle, Hendersonville, both of N.C.

[73] Assignee: General Electric Company, New York, N.Y.

[22] Filed: Feb. 21, 1975

[21] Appl. No.: 551,709

[52] U.S. Cl. ..... 339/95 R; 85/32 V; 339/180

[51] Int. Cl.[2] ..... H01R 17/20

[58] Field of Search ..... 339/86, 93 L, 95, 99 L, 339/176 L, 177 L, 180, 199; 85/32 V

[56] References Cited

UNITED STATES PATENTS

| | | | |
|---|---|---|---|
| 463,763 | 11/1891 | Voigt | 339/180 |
| 819,702 | 5/1906 | Murphy | 339/86 |
| 1,088,914 | 3/1914 | Marks et al. | 339/180 |
| 1,336,607 | 4/1920 | Benjamin | 339/180 |
| 2,385,478 | 9/1945 | Steinmayer | 339/180 |
| 3,170,750 | 2/1965 | Appleton | 339/180 |
| 3,890,027 | 6/1975 | Orr et al. | 339/180 |

*Primary Examiner*—Roy Lake
*Assistant Examiner*—Neil Abrams
*Attorney, Agent, or Firm*—Sidney Greenberg

[57] ABSTRACT

Electrical socket device includes a threaded shell having inwardly projecting protuberances in the shell for cleaning the threaded base of the lamp when screwed into the socket. A resiliently mounted center contact arranged at the bottom of the socket has a central depression with a slot formed therein for cleaning the bottom contact of the lamp base.

8 Claims, 7 Drawing Figures

ELECTRICAL SOCKET

The present invention relates to electrical sockets, and more particularly concerns electrical sockets for removably mounting lamps.

It is an object of the invention to provide an electrical socket which maintains good electrical connection with the base of a lamp or other electrical device removably mounted therein.

A particular object of the invention is to provide an electrical socket, especially of threaded type, which serves to clean the threaded base of a lamp or other electrical device received therein.

Still another object of the invention is to provide an electrical socket of the above type which serves to clean the bottom contact of the lamp or other electrical device received therein.

Another object of the invention is to provide an electrical socket of the above type which also serves to firmly hold the lamp against loosening due to vibration while avoiding substantial hindrance to removal of the lamp when desired.

Other objects and advantages will become apparent from the following description and the appended claims. With the above objects in view, the present invention relates to an electrical socket comprising, in combination, a socket shell formed with a screw thread defining a groove extending around the shell for threadably receiving the complementary thread of an electrical device adapted to being removably mounted in the socket, the shell being formed in the groove with at least one protuberance extending inwardly thereof, the protuberance being formed with a front ramp and a rear ramp forming a ridge therebetween extending transverse the groove, whereby when the electrical device is screwed into the shell with its thread first engaging the front ramp and then the rear ramp, the thread thereof is cleaned by contact with the ridge during relative movement therebetween.

In accordance with another feature of the invention, the housing of the socket has a center contact resiliently mounted at the bottom thereof which is adapted to be engaged by the bottom contact of the electrical device, the center contact having a contact surface formed with a central depression and a slot extending across the depression, whereby the base contact of the electrical device is cleaned by the edges of the slot when the electrical device is screwed into contact with the center contact.

The invention will be better understood from the following description taken in conjunction with the accompanying drawing, in which.

Figure 1:
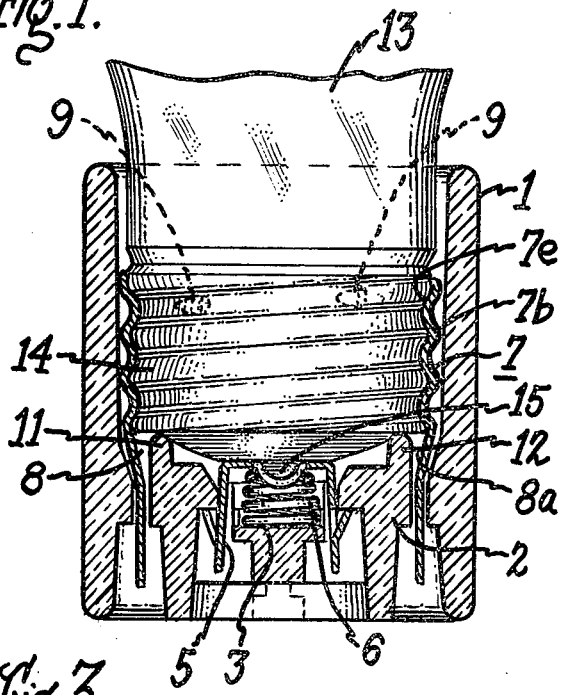
FIG. 1 is a cross-sectional view in elevation of an embodiment of the socket device of the invention showing the base portion of a lamp in assembly therewith.
Figure 2:
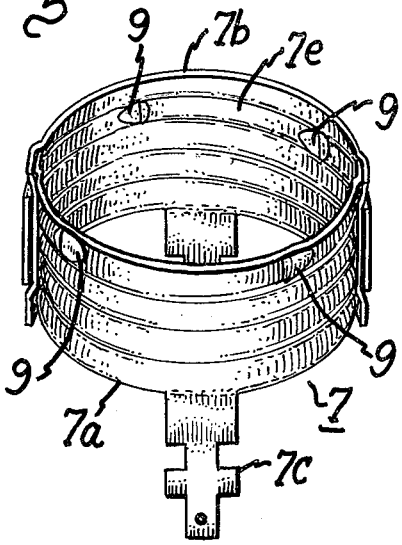
FIG. 2 is a perspective view of the threaded shell contained in the socket housing shown in FIG. 1.
Figure 5:
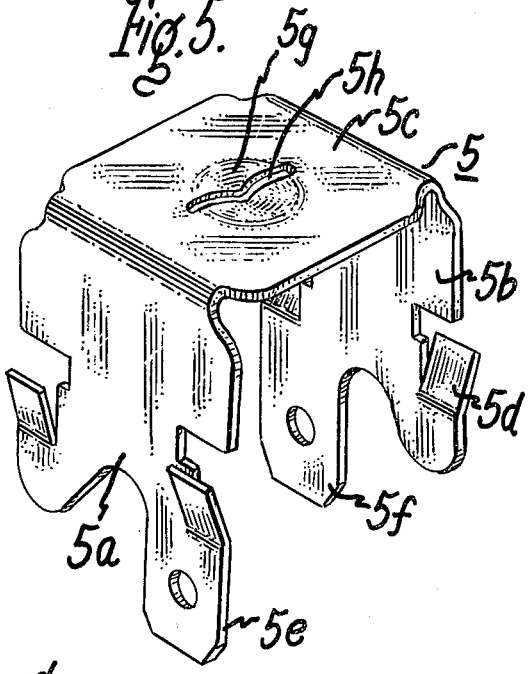
FIG. 5 is a perspective view in enlarged scale of the center contact contained in the socket shown in FIG. 1.

Referring now to the drawing, and particularly to FIG. 1, there is shown an embodiment of the invention which comprises a cylindrical socket housing 1 of electrical insulating material such as porcelain which is open at its top end and if formed with a transverse base portion 2 near its bottom end. In its central region, base portion 2 is formed with a recessed, somewhat circular seat 3 for receiving coil spring 6. On opposite sides of recess 3, base portion 2 has a pair of slots for respectively receiving legs 5*a*, 5*b* of a U-shaped conductive contact member 5 (see FIG. 5) which has a web portion 5*c* which overlies the top of coil spring 6 in the assembled condition of the parts. Legs 5*a*, 5*b* of contact member 5 are provided with punched-out projections or barbs 5*d*, so that when contact member 5 is inserted into the slots straddling coil spring 6, barbs 5*d* engage the underside of base portion 2 for holding contact member 5 in assembly in socket housing 1 with web portion 5*c* pressing resiliently against and compressing coil spring 6, as seen in FIG. 1.

Legs 5*a*, 5*b* of contact member 5 have elongated terminal portions or tabs 5*e*, 5*f*, respectively, at their ends which project below the bottom of the slots for receiving pushon terminal connectors of known type (not shown).

Fitting within socket housing 1 is conductive screw shell 7 which, in the illustrated embodiment, comprises two curved shell parts 7*a*, 7*b* having tongue and slot portions at their respective joining edges for securing the two parts together. It will be understood, however, that screw shell 7 may be of conventional unitary form if desired. Projecting downwardly from opposite sides of the cylindrical threaded portion of screw shell 7 are terminal strips formed with transverse projections 7*c*, the arrangement being such that when the terminal strips are inserted through corresponding slots 8, 8*a* in base portion 2, the ends of the terminal strips may be twisted slightly so that projections 7*c* engage the underside of base portion 2 to hold the conductive shell in assembly in socket housing 1.

On its upper surface, base portion 2 is formed with parallel ledges 11, 12 located inwardly of slots 8, 8*a* and having substantially co-planar top surfaces. As seen in FIG. 1, showing a lamp 13 of conventional type mounted in socket housing 1 with its threaded base 14 screwed into screw shell 7, ledges 11, 12 are so spaced as to engage the bottom shoulder of lamp base 14 outwardly of contact 15 at the bottom of lamp 13. The ledges thereby serve as stop means for automatically aligning lamp 13 in the proper position along the central axis of socket housing 1 and thus provide consistent location of the light center relative to the optical parts of the lighting fixture such as the reflector. The described arrangement is such that central contact member 5, being resiliently mounted in engagement with coil spring 6, serves in effect as a "floating" contact which is readily movable in all directions. Contact member 5 thus automatically accommodates to the movement of lamp 13 and does not tend to tilt or cock the lamp at an angle to the socket axis. Preferably, the top surface of central member 5 has a depression or indentation 5*g* for receiving a complementary, somewhat hemispherical contact 15 such as is usually present in conventional lamps. Indentation 5*g* serves not only to provide an improved electrical contact between the mating parts but also, by extending into the end of coil spring 6, aids in centering the latter in the assembly.

Other structural details and functions of the described socket parts are disclosed in copending application of Orr et al Ser. No. 411,672 filed Nov. 1, 1973, now U.S. Pat. No. 3,890,027 issued June 17, 1975, and assigned to the same assignee as the present invention, and the disclosure thereof is accordingly incorporated herein by reference.

With the advent of lamps in recent years which have much longer operating life than prior lamps, the problem of oxidation and corrosion of lamp bases resulting in their poor electrical contact with the conductive parts of the socket has become particularly troublesome, and has been made worse by the higher ambient temperatures in which such lamps are operated nowadays, particularly in indoor applications. Also, in many cases, the nickel plating of lamp bases which has previously been used on long life lamps has now been dispensed with for reasons of economy or other reasons, leaving the brass material of the lamp base susceptible to more rapid oxidation and resultant deterioration of its electrical contact properties.

In accordance with the present invention, means are provided on socket shell 7 and center contact member 5 of the socket for automatically cleaning the corresponding lamp base conducting portions when lamp 13 is screwed into and out of the socket, thereby assuring good electrical contact between the socket and the lamp base.

Figure 3:
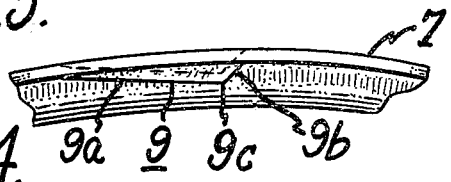
FIGS. 3 and 4 show different views of thread cleaning protuberances formed in the socket shell shown in FIG. 2.
Figure 4:
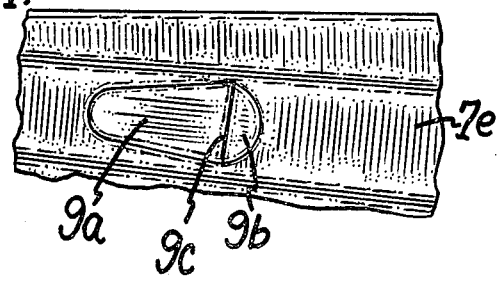

For this purpose, there is provided in the illustrated embodiment a plurality of bosses or protuberances 9 punched in the upper i.e., entrance portion of screw shell 7 so as to project radially inwardly from groove **7*e* which extends helically around shell 7. As seen in FIGS. 3 and 4, each protuberance 9 is formed with a front ramp 9*a* which slopes upwardly from groove 7*e* in the clockwise direction as viewed from the top end of socket shell 7, a rear ramp 9*b* which slopes downwardly in that direction, and a ridge 9*c* defined by the tops of the two ramps which extends transversely of groove 7*e* and which preferably has a relatively sharp edge. Protuberences 9 project radially inwardly a distance less than the innermost surface of the screw thread of socket shell 7, and in a preferred embodiment, rear ramp 9*b* is substantially steeper in slope than front ramp 9*a*. The arrangement is such that when lamp base 14 is screwed into socket shell 7, the outer surface of the helical thread of lamp base 14 comes into contact with proturberances 9 and is scraped clean by the sharp edge of ridge 9*c*, but without shaving off a substantial amount of material. As will be evident, turning of lamp base 14 clockwise in the socket shell for installing lamp 13 causes the lamp base thread to readily ride up front ramp 9*a* of each protuberance 9, but turning the lamp base counterclockwise in the process of unscrewing lamp 13 from the socket encounters substantially more resistance due to the steeper slope of rear ramp 9*b* of the protuberances. Accordingly, protuberances 9 serve not only to clean the surface of the lamp base threads, but also firmly retain lamp 13 in installed position in the socket to resist loosening of lamp base 14** in the socket due to vibrations.

Figure 6:
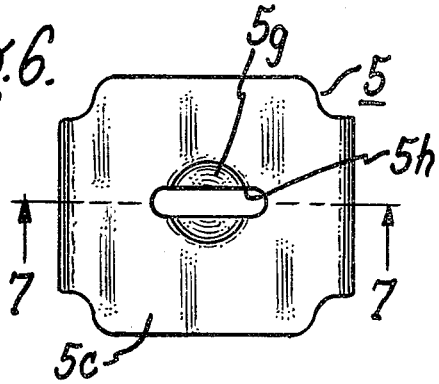
FIGS. 6 and 7 show different views of the contact cleaning slot formed in the socket contact shown in FIG. 5.
Figure 7:
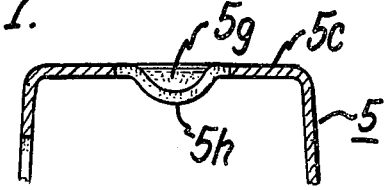

In accordance with another feature of the invention, center contact member 5 is formed in its indented upper surface with a slot **5*h* which is defined by spaced elongated edges and extends across at least the entire diameter of circular recess 5*g* (see FIG. 6). By virtue of this structure, the edges of slot 5*h* serve to scrape clean the bottom center contact 15 of lamp 13 as the lamp is screwed into the socket, and its center contact 15, which is typically a soft solder material of somewhat hemispherical shape, comes into compression engagement with the indented upper surface of center contact member 5. The arrangement is such that the slot edges lightly scrape the relatively soft solder contact 15 without shaving off substantial amounts of the contact material. To this end, slot 5*h* is typically formed by punching down on the top surface of member 5 so that the burr formed by the punching operation is on the underside of the contact member surface. Slot 5*h* preferably extends diametrically across and slightly beyond recess 5*g*. In this way, an area all around lamp contact 15 is wiped clean even though the lamp cannot be rotated a full 360° after coming into engagement with contact member 5**.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

We claim:

1. An electrical socket comprising, in combination, a socket shell formed with a screw thread defining a groove extending around said shell for threadably receiving the complementary thread of an electrical device adapted to be removably mounted in the socket, said shell being formed in said groove with at least one protuberance extending radially inwardly thereof, said protuberance being formed with a front ramp and a rear ramp forming a ridge therebetween extending transverse said groove, the entire outer margin of the protuberance being continuous with and fixed relative to the wall of the groove, whereby when the electrical device is screwed into said shell with its thread first engaging said front ramp and then said rear ramp the thread thereof is cleaned by contact with said ridge during relative movement therebetween.

2. A socket as defined in claim 1, a socket housing containing said socket shell and having a center contact member resiliently mounted at the bottom thereof adapted to be engaged by the bottom contact of the electrical device, said center contact member having a contact surface formed with a depression and a slot having elongated spaced edges extending across said depression, whereby the bottom contact of the electrical device is cleaned by said edges of said slot when the electrical device is screwed into contact with said center contact member.

3. A socket as defined in claim 1, said rear ramp of said protuberance having a steeper slope than said front ramp for firmly holding said electrical device in installed position in the socket.

4. A socket as defined in claim 1, including a plurality of similar protuberances formed in said shell.

5. A socket as defined in claim 4, said shell having an entrance portion in which the electrical device is first received, said protuberances formed in said shell at said entrance portion thereof.

6. A socket as defined in claim 1, said protuberance extending radially inwardly a distance less than the innermost surface of the screw thread of said socket shell.

7. An electrical socket comprising, in combination, a socket housing having an open top and a bottom portion and containing a threaded socket shell for threadably receiving an electrical device adapted to be removably mounted in the socket and having a bottom contact, said socket housing having a resiliently mounted center contact member on said bottom portion adapted to be engaged by the bottom contact of the electrical device, said center contact member having a contact surface formed with a depression and a slot having elongated spaced edges extending across said depression, whereby the bottom contact of the electrical device is cleaned by said edges of said slot when the electrical device is screwed into contact with said center contact member, said slot being longer than the diameter of said depression.

8. An electrical socket comprising, in combination, a socket housing having an open top and a bottom portion and containing a threaded socket shell for threadably receiving an electrical device adapted to be removably mounted in the socket and having a bottom contact, said socket housing having a resiliently mounted center contact member on said bottom portion adapted to be engaged by the bottom contact of the electrical device, said center contact member having a contact surface formed with a depression and a slot having elongated spaced edges extending across said depression, whereby the bottom contact of the electrical device is cleaned by said edges of said slot when the electrical device is screwed into contact with said center contact member, said socket shell having a screw thread defining a groove extending around said shell, said shell being formed in said groove with at least one protuberance extending radially inwardly thereof, said protuberance being formed with a front ramp and a rear ramp forming a ridge therebetween extending transverse said groove, the entire outer margin of the protuberance being continuous with and fixed relative to the wall of the groove, whereby when the electrical device is screwed into said shell with its thread first engaging said front ramp and then said rear ramp, the thread thereof is cleaned by contact with said ridge during relative movement therebetween.

* * * * *